United States Patent [19]

Gadoury et al.

[11] 4,345,344

[45] Aug. 24, 1982

[54] HOSPITAL BED

[75] Inventors: André Gadoury; Victor Pinheiro, both of Ste-Foy; Martin Pernicka, Loretteville, all of Canada

[73] Assignee: Centre de Recherche Industrielle du Quebec, Ste-Foy, Canada

[21] Appl. No.: 138,554

[22] Filed: Apr. 8, 1980

[51] Int. Cl.[3] ..... A61G 7/00

[52] U.S. Cl. ..... 5/62; 5/63; 5/68

[58] Field of Search ..... 5/62, 63, 64, 65, 66, 5/67, 68, 69

[56] References Cited

U.S. PATENT DOCUMENTS

| | | | |
|---|---|---|---|
| 1,908,530 | 5/1933 | Nixon et al. | 5/67 |
| 2,159,883 | 5/1939 | Caldwell | 5/66 |
| 2,526,466 | 10/1950 | Friesen | 5/62 |
| 2,633,578 | 4/1953 | Deves et al. | 5/63 |
| 2,651,785 | 9/1953 | Berner | 5/63 |
| 3,059,248 | 10/1962 | Wetzler | 5/63 |
| 3,073,635 | 1/1963 | Schaefer | 5/64 X |
| 3,081,463 | 3/1963 | Williams et al. | 5/63 |
| 3,324,484 | 6/1967 | Benoit | 5/66 |
| 3,456,269 | 7/1969 | Goodman | 5/66 |
| 4,062,074 | 12/1977 | Holland | 5/63 |
| 4,174,547 | 11/1979 | Wetzler | 5/63 X |

FOREIGN PATENT DOCUMENTS

| | | | |
|---|---|---|---|
| 792955 | 8/1968 | Canada | 5/63 |
| 851402 | 9/1970 | Canada | 5/63 |
| 1579936 | 11/1980 | United Kingdom | 5/67 |

*Primary Examiner*—Stephen J. Novosad
*Assistant Examiner*—George A. Suchfield
*Attorney, Agent, or Firm*—Oblon, Fisher, Spivak, McClelland & Maier

[57] ABSTRACT

A hospital bed of the type having a base frame and a displaceable frame supported above the base frame by adjustable leg supports whereby the adjustable frame may be displaced vertically above the base frame in parallel relation or at an angular position such as a trendelenburg position. The leg supports are connected in pair and spaced apart adjacent a respective end of the frames. An articulated panelized frame is supported above the displaceable frame and the panels are articulated by an actuating mechanism. A first drive is connected to the adjustable leg supports to cause the displaceable frame to be displaced above the base frame. A follower mechanism is connected to a lower end of the leg supports to maintain the displaceable frame in lateral relationship with the base frame when displaced relative thereto. A second drive is connected to the actuating mechanism of the panelized frame to selectively displace the angular position of the panels.

18 Claims, 12 Drawing Figures

Fig. 4a
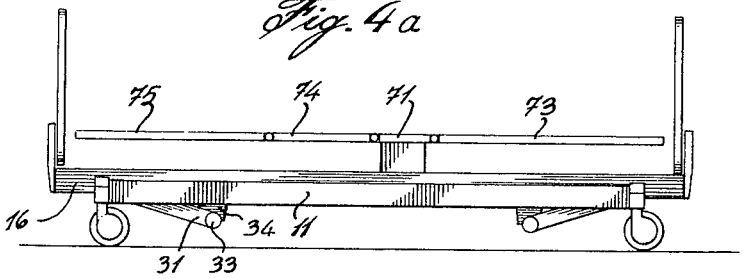
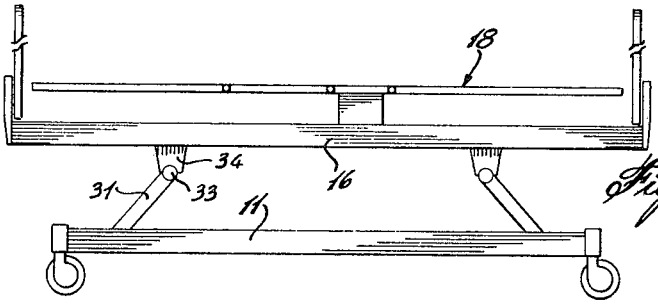
Fig. 4b
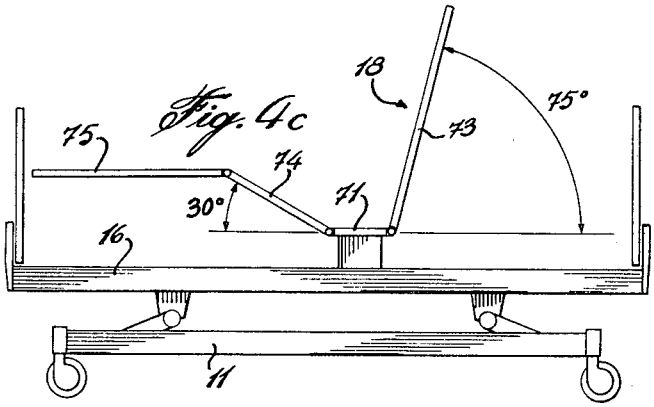
Fig. 4c
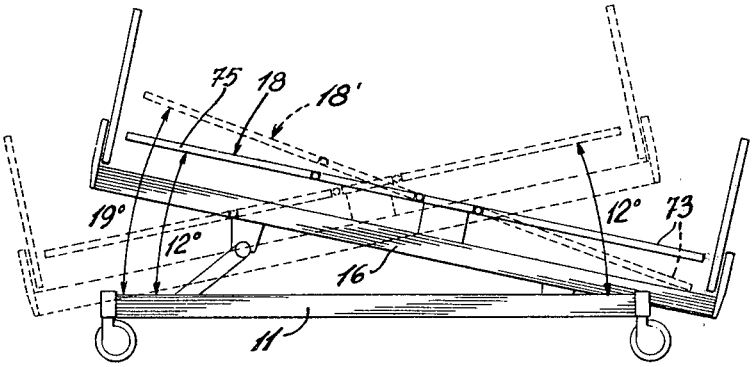
Fig. 4d

HOSPITAL BED

BACKGROUND OF INVENTION (a) Field of the Invention

The present invention relates to an improved hospital bed construction and wherein a displaceable frame is supported above a base frame by adjustable leg supports. The leg supports are constituted by fixed members and are displaced on a pivot shaft to cause a displacement of the displaceable frame relative to the base frame.

(b) Description of Prior Art

Various hospital bed structures are known where a displaceable frame is supported and displaced above a base frame either in parallel relationship to the base frame or at angular positions and providing both the trendelenburg and reverse trendelenburg positions. However, in order to support the displaceable frame in these various positions, various leg support structures have been provided and suggested. A disadvantage of the leg supports known is that these utilize many link arms and connections and are complex to construct, resulting in numerous failures requiring excessive maintenance. Further, in view of the many links involved, the safety of some of the supports is questioned.

Furthermore, there is required the necessity of providing simple mechanisms to displace the leg supports whereby the displaceable frame assumes a desirable position and can be retained in that position.

SUMMARY OF INVENTION

It is a feature of the present invention to provide a hospital bed which substantially overcomes the above-mentioned disadvantages.

According to the above feature, from a broad aspect, the present invention provides a hospital bed comprising a base frame and a displaceable frame supported thereabove by adjustable leg supports. The leg supports are connected in pair and spaced apart adjacent a respective end of the frames. The leg supports of each pair operate in unison and each has an upper link arm and a lower link arm. The link arms are connected at a common end to a fixed pivot rod for displacement of their axes thereabout. The pivot rod is fixed relative to the displaceable frame. First drive means is connected to the adjustable leg supports for causing the displaceable frame to be displaced above the base frame. Follower means is connected to a lower end of the leg supports to maintain the displaceable frame in lateral relationship with the base frame when displaced relative thereto.

BRIEF DESCRIPTION OF DRAWINGS

A preferred embodiment of the present invention will now be described with reference to the example thereof illustrated by the accompanying drawings, in which:

FIGS. 4*a* to 4*d* are side elevational views illustrating the various positions of the displaceable frame and the articulated panelized frame;

DESCRIPTION OF PREFERRED EMBODIMENTS

Figure 1:
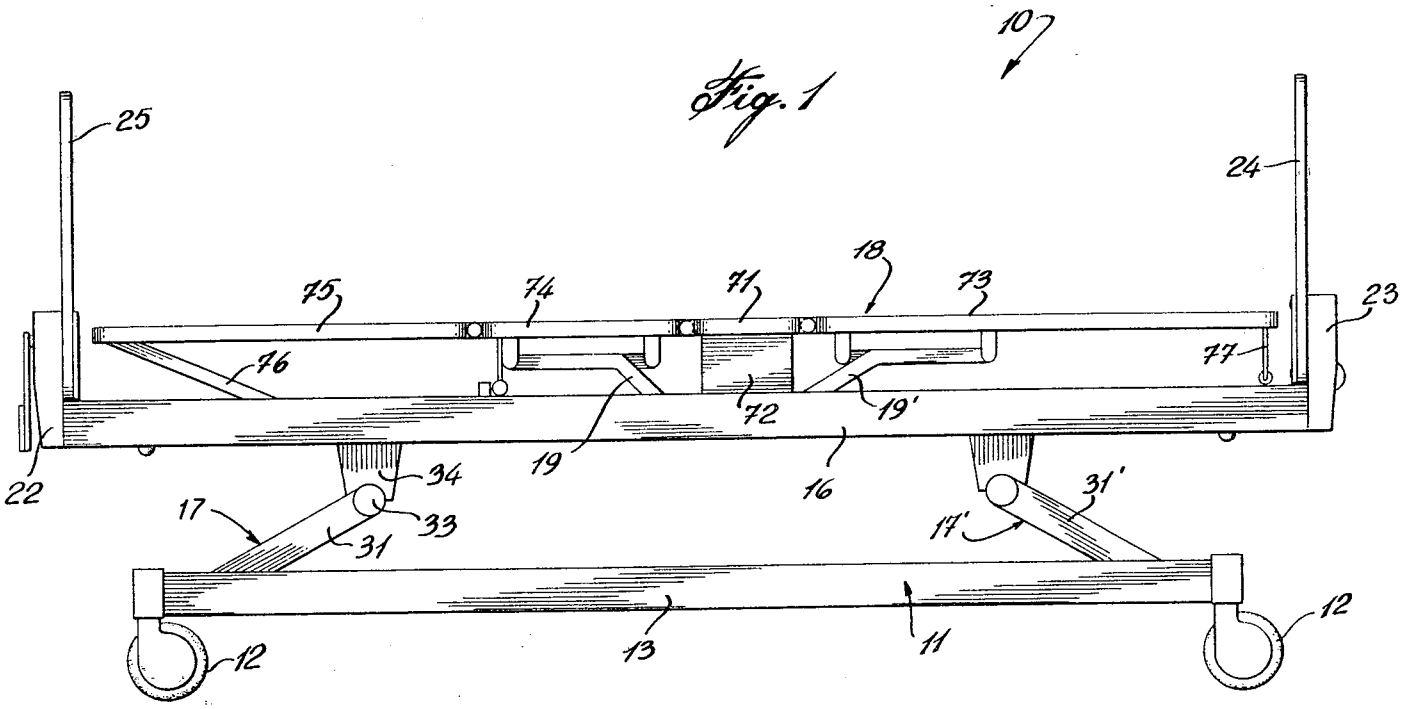
FIG. 1 is a side elevational view of the hospital bed of the present invention.
Figure 2:
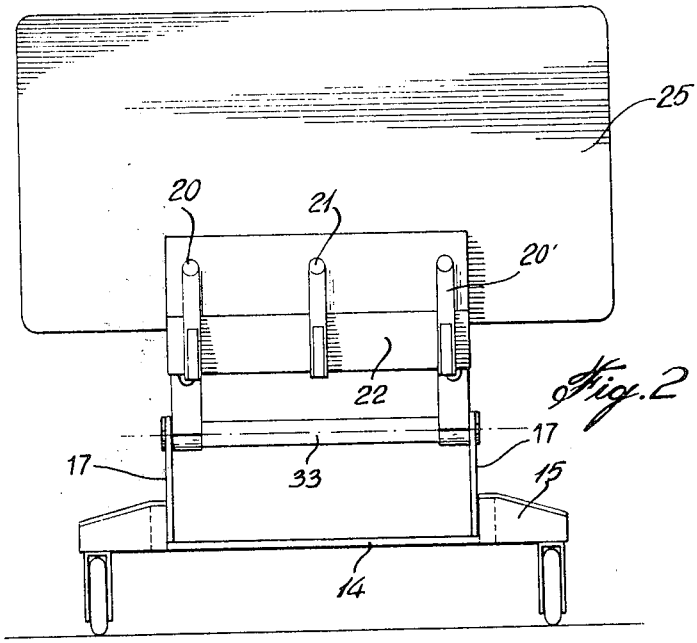
FIG. 2 is an end view of the foot of the bed.

Referring now to the drawings and more particularly to FIGS. 1 to 4, there is shown generally at 10 the hospital bed of the present invention. The bed comprises a base frame 11 which is herein shown supported on casters 12. The base frame is constituted by elongated parallel channel members 13 and cross members 14 at opposed ends thereof. A footstand 15 is secured on top of the casters 12 in a respective corner of the base frame 11.

A rectangular displaceable frame 16 is supported above the base frame 11 by adjustable leg supports 17. The leg supports 17 are connected in pairs 17 and 17' adjacent a respective end of the frames.

An articulated panelized frame 18 is supported above the displaceable frame 16 and has a plurality of panels hingedly interconnected together. Actuating means in the form of displaceable levers 19 and 19' are connected to selected ones of the panels and a second drive means displaces these actuating levers to selectively displace the angular position of the panels. This is done by selectively rotating the cranks 20 and 20' which constitute the second drive means and which connect respectively to actuating levers 19 and 19'. The center crank 21 actuates the drive, herein referred to as the first drive means, which displaces the adjustable leg supports 17 and 17' to cause the displaceable frame 16 to be moved above the base frame 11.

Figure 3:
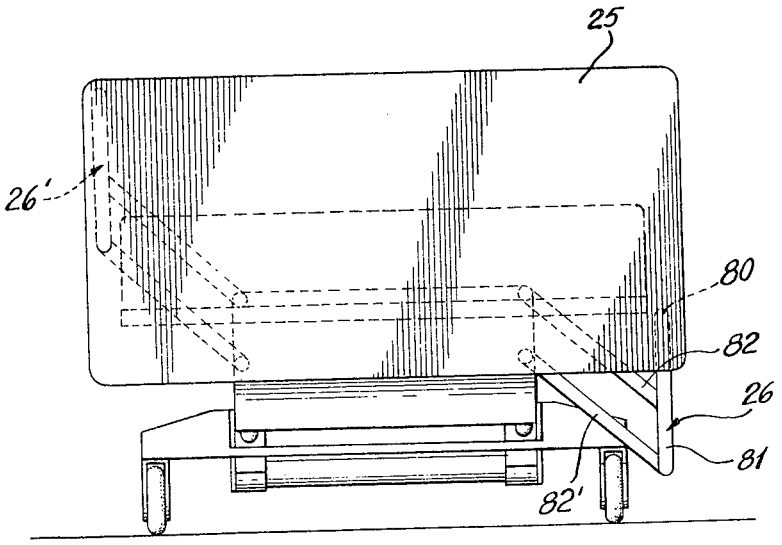
FIG. 3 is an end view of the head of the bed.

A foot support frame 22 is secured to one end of the displaceable frame 16 and a head support frame 23 is secured at the opposite end. A headboard 24 and a footboard 25 are removably secured to the head support frame and the foot support frame, respectively. Also, the support frames 22 and 23 are adapted to retain various accessories (not shown) which are usually utilized in hospitals, such as harnesses or vials, etc. As shown in FIG. 3, side guards 26 may be provided on each side of the displaceable frame and these are displaceable to a position as shown at 26, which is inoperative, and to an elevated operative position, as shown at 26'. The side guards are hingedly secured at opposed ends to respective ones of the head and foot support frames 23 and 22.

Referring now to FIGS. 4*a* to 4*d*, there is shown examples of the various positions of the displaceable frame 16 with respect to the base frame 11. FIG. 4*a* shows the displaceable frame 16 in its lowermost position with respect to the base frame 11. FIG. 4*b* shows the displaceable frame 16 in its uppermost position with respect to the base frame 11. FIG. 4*c* shows the displaceable frame at an intermediate position with respect to the base frame and also illustrates the maximum angular displacement of some of the panels of the articulated panelized frame 18. As shown, the head or upper panel 73 may be displaced and held at any position within an angle of 75° with respect to the base frame 16. The thigh panel 74 is also displaceable and securable within an angle of 30° with respect to the base frame 16. FIG. 4*d* illustrates the displaceable frame in a trendelenburg position, in solid lines, and in a reverse trendelenburg position, in phantom lines. As shown in this figure, the foot panel 75 of the frame 18 is disposed at an angle of 19° with respect to the base frame 11. A support bracket 76 supports the panel 75 at a plurality of selected angles. The articulated panelized frame 18 may have some of its panels displaced to assume a position as shown in phantom lines at 18' and wherein the foot panel extends at an angle of 19° with respect to the base frame. The upper panel is displaced at its end to rest on the top surface of the displaceable frame 16.

Figure 5:
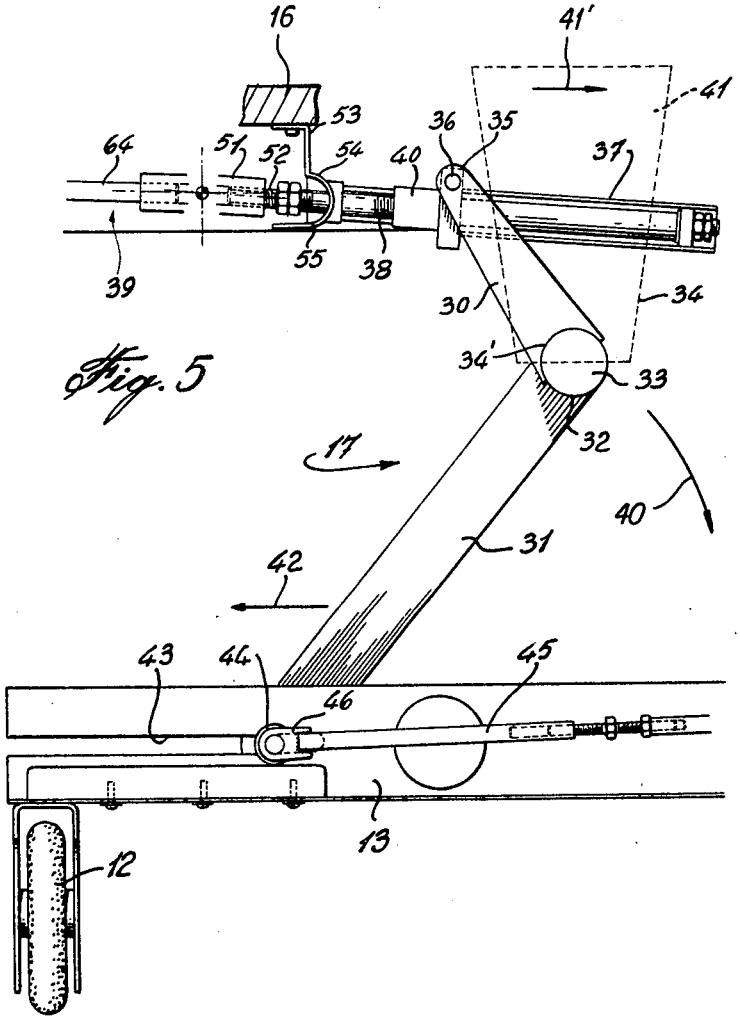
FIG. 5 is a fragmented side elevation showing the adjustable leg supports, its drive and the follower mechanism.
Figure 6:
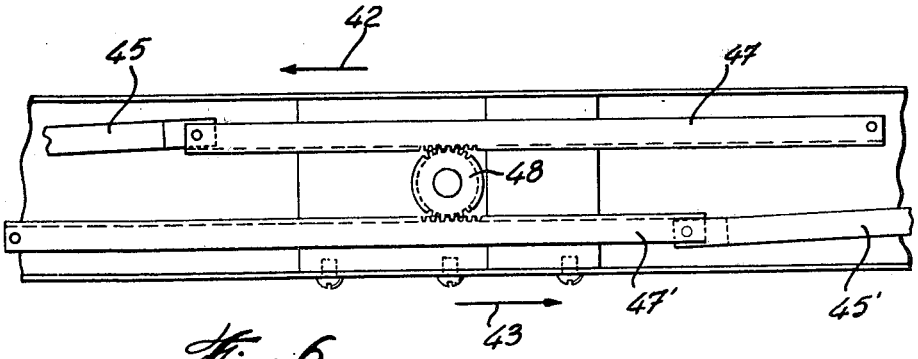
FIG. 6 is a fragmented side elevation showing a portion of the follower mechanism.

Referring now to FIGS. 5 and 6, there is shown the construction of the adjustable leg supports 17. As herein shown, each leg of a pair of leg supports comprises an upper link arm 30 and a lower link arm 31. The upper end 32 of the lower link arm 31 is immovably secured to a pivot rod 33 which is retained in a fixed position in a bushing (not shown) held by a support plate 34 but axially rotatable therein. The lower end 34' of the upper link arm 30 is also immovably secured to the pivot rod 33 at a predetermined angle with respect to the lower link arm 31. The top end 35 of the upper link arm 30 is pivotally secured at pivot point 36 to a displaceable member or housing 37 which is in threaded engagement with an elongated threaded bolt 38 which is axially rotated by a first drive means 39. The first drive means displaces the top end of the upper link arm 30 along a limited arcuate path designated by the arc 40 and this limited travel is determined by the maximum relative displacement between the threaded housing 37 and the threaded bolt 38.

It can be seen in FIG. 5 that by displacing the upper link arm 30 in the direction of the arrow 41' the lower link arm 31 will be displaced in the direction of arrow 42. The lower end of the lower link arm 31 is displaceably secured by a follower mechanism disposed within the channel members 13 of the base frame 11.

As herein shown, the follower mechanism is constituted by capturing the lower end of the lower link arms 31 in a respective elongated slot 43 provided at each end of the base frame 11. An idler wheel 44 is secured to the lower end of the link arm 31 and captive within the elongated slot 43. A link rod 45 is secured to a bracket 46 attached to the idler wheel 44 and is disposed inside the channel member 13. As the link arm 31 is displaced in the direction of arrow 42, the link rod 45 will be pulled in that direction.

As shown in FIG. 6, the other end of the link rods 45 are each secured to a toothed rod section 47 which is in gear meshing engagement with an idler gear 48. The other link rod 45', which is secured to the bottom end of the other link arm 31' in the same channel, also has an end thereof secured to a toothed rod 47' disposed on the opposite side of the idler gear 48. Accordingly, as the toothed rod 47 moves in the direction of arrow 42 the idler gear will be rotated counter-clockwise causing the toothed rod 47' to be displaced in the opposite direction as indicated by arrow 43. Accordingly, with the lower link arms 31 and 31' of the adjustable leg supports moving outwardly in the channel member 13, the displaceable frame 16 will be lowered and maintained in parallel relationship with the base frame by the interconnection of the follower mechanism just described.

Figure 8:
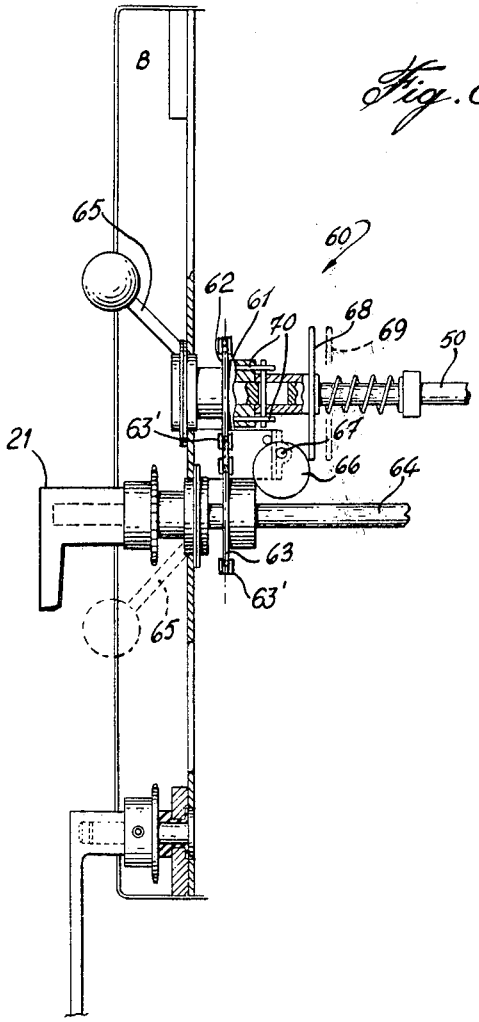
FIG. 8 is a fragmented top elevation view showing part of the drive mechanisms and the clutch mechanism.

With reference now to FIGS. 5 and 8, the construction of the drive means to displace the upper link arm 30 will be described. As previously mentioned, a threaded bolt 38 is activated to displace the housing 37 and the attachment point at the top end 35 of the link arm. The drive is obtained by turning the crank 21 in the foot support frame 22 (see FIG. 2) and this causes rotation of the drive rod 64 which is coupled to the threaded bolt 38 through a universal joint coupling 51. The threaded bolt 38 has a free end 52 extending through a bracket 53 which is secured under the displaceable frame 16. The bracket 53 has an arcuate protuberance 54 having an elongate vertical slot 55 therein and through which the bolt 38 passes. The universal joint connection 51 and the slot 55 permit vertical displacement of the bolt 38 in the slot as the bolt is threaded or unthreaded and caused by the arcuate displacement of the free end of the upper link arm 30.

Referring now more specifically to FIG. 8, there is shown the construction of a clutch mechanism 60 whereby both pairs of adjustable leg supports 17 and 17' can be operated in unison by a single drive initiated by the crank arm 21. As herein shown, the clutch mechanism has a disengageable drive member 61 which has a drive gear 62 secured thereto. This drive gear 62 is in engagement with the drive gear 63 secured to the drive rod 64 by means of an endless chain 63' engaged about both gears. When it is desired to raise the entire displaceable frame 16 or to lower it, both the drive rod 50 and drive rod 64 are in engagement. To determine this engagement, there is provided a clutch lever 65 which is displaceable to indicated positions where both adjustable leg supports are engaged or leg support 17' only is engaged, that is to say, the leg support 17 and drive rod 50 being disengaged.

The leg supports 17 are disengaged from the drive by displacing a cam element 66. This cam element is secured to an end portion 67 of the clutch lever 65 and abuts a displaceable plate 68 to move it to a disengaged position as shown at phantom line 69. In that position, the locking pins 70 are withdrawn from the gear 62 disconnecting the gear from the drive rod 50 and thereby disconnecting the drive to it. Accordingly, the crank lever 21 will now only rotate the drive rod 64 when it is displaced in a clockwise or counter-clockwise direction.

Referring now additionally to FIG. 4*d*, the trendelenburg position illustrated therein is obtained by firstly engaging both adjustable leg supports 17 and 17' and raising the adjustable frame 16 to its uppermost position as shown in FIG. 4*b*. The rear adjustable leg support 17' is then disengaged and the front adjustable leg supports are lowered to their lowermost position. During the lowering of the leg supports, the force exerts a pressure on the leg supports to cause the pivot rod 33 to move in the direction of arc 40, as shown in FIG. 5. The lower end of link arm 31 will tend to move in the direction of arrow 42. However, in the trendelenburg position the disengagement of leg support 17' does not permit its respective pivot rod to move along an arc as would the pivot rod 33 of leg supports 17 along arc 40. Since the movement of the lower link arm 31 in the direction of arrow 42 is transmitted to the lower link arm of leg supports 17' through their respective linkage 45, 45' and idler gear 48, the pivot rod 33 of leg support 17' will be displaced horizontally together with the idler wheels of leg supports 17'. This will cause the displaceable frame 16 to shift horizontally with respect to the base frame while at the same time being pivoted around pivot point joining its top end of the upper link arm to the displaceable housing. In order to displace the frame 16 to a reverse trendelenburg position, the displaceable frame is displaced to its lowermost position as shown in FIG. 4a and the adjustable leg supports 17 are disengaged and the front leg supports 17' are engaged and raised to its maximum position. Of course, any intermediate angular position of either end of the displaceable frame 16 can be achieved by this operation.

Figure 7:
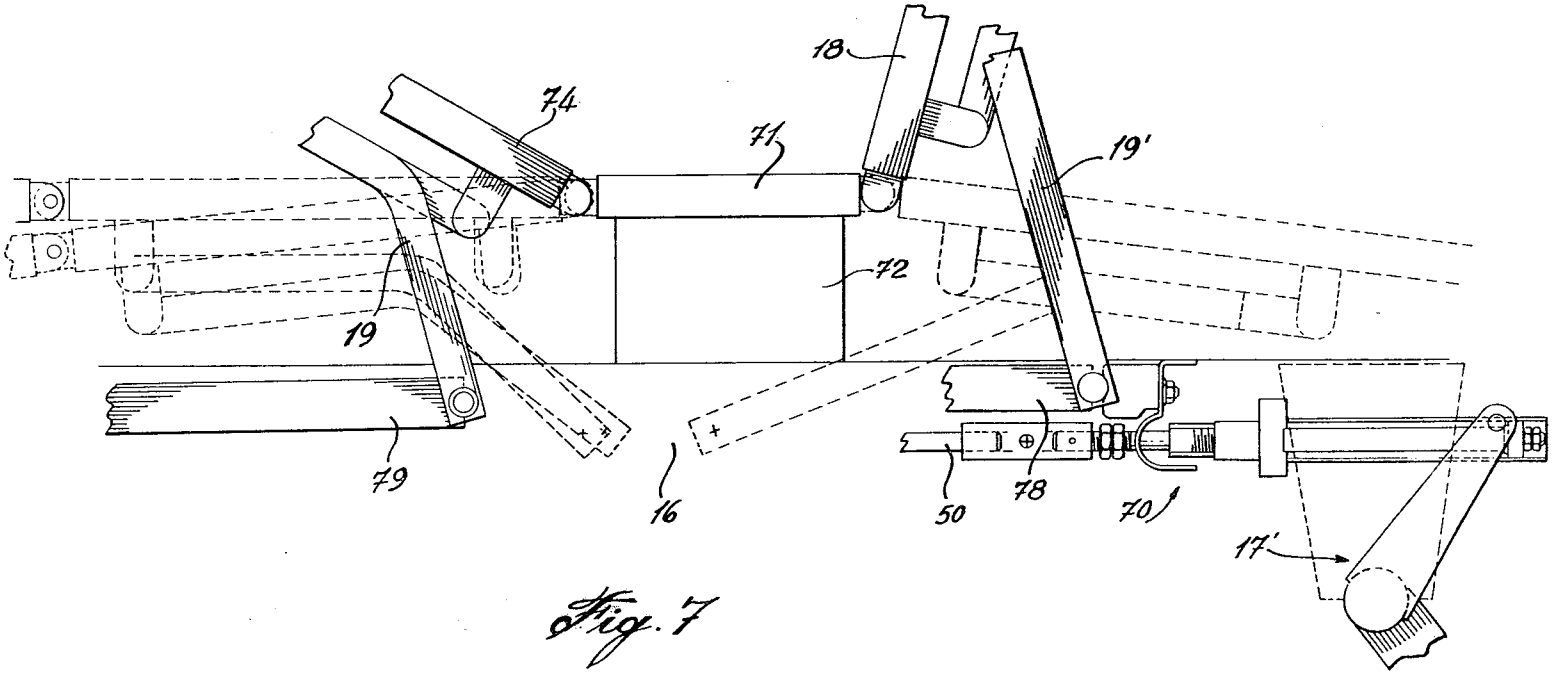
FIG. 7 is a side elevation showing the drive of the other pair of adjustable leg supports and the connection of the actuating levers to the panelized frame.

Referring now to FIG. 7, there is shown the disposition of the drive means 70 for displacing the adjustable leg support 17' and it is of the same construction as the drive means 39 for the other adjustable leg supports 17. As can be seen from this figure, and further with reference to FIGS. 1, 4c and 4d, there is shown the construction of the articulated panelized frame 18. The frame comprises a fixed metal section panel 71 immovably secured to the displaceable frame 16 by the bracket 72. An upper panel 73 is disposed intermediate the metal section 71 and the headboard 24 and actuating lever 19' is connected thereto whereby this panel may be displaced at any desired angle within a 75° angle range, as shown in FIG. 4c. A thigh panel 74 is hingedly secured to the other side of the metal section panel 71 and is also hingedly displaced through an angle of 30° by the lever 19 and as shown in FIG. 4c. This panel is further hingedly connected to a foot panel 75 which is entrained therewith. As shown in FIG. 1, a support bracket 76 depends from a free end of the foot panel 75 and has an engageable lower end (not shown) for retention in a selected one of a plurality of engagement slots in a channel member (not shown) to retain the free end of the foot panel elevated at a desired position relative to the displaceable frame. A hinge support bracket 77 is provided under the upper panel at the free end thereof to support it horizontally.

Referring now more specifically to FIG. 7, it can be seen that the bottom ends of the actuating levers 19 and 19' are each respectively secured to axially displaceable members 78 and 79 which are displaced axially by rotation of the crank arms 20 and 20'. The axially displaceable members 78 and 79 are in threaded engagement with a respective elongated threaded bolt (not shown) which is axially rotatable by a respective one of the crank arms 20 and 20'. Thus, by rotating these bolts axially, the displaceable members 78 and 79 will be displaced along the axis of the bolt in a forward or rearward direction depending on the direction of rotation of the threaded bolt. Of course, the threaded bolt is held stationary under the frame and can only rotate axially. It is also foreseen that other displaceable mechanisms may be used to displace the bottom ends of the actuating levers 19 and 19' in order to displace and retain their associated panels 74 and 73 at a desired angle within their displacement arc.

Figure 9:
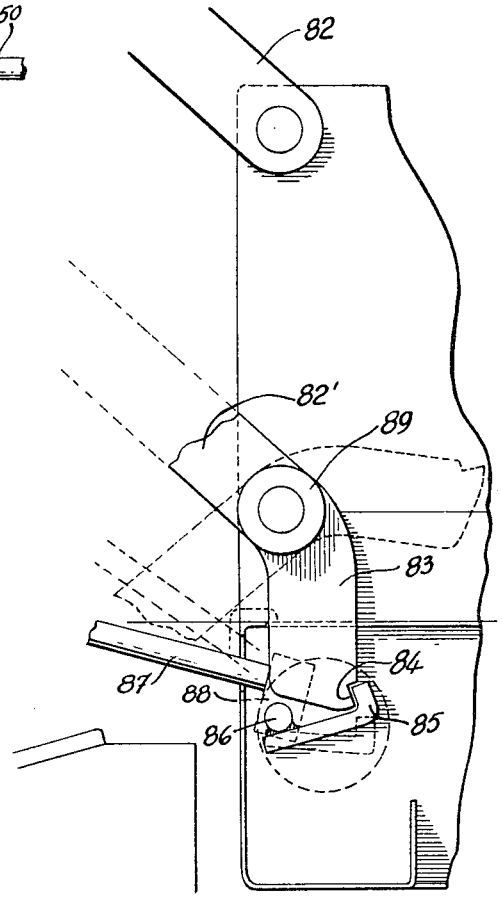
FIG. 9 is a fragmented side view showing the connection of the side guards.

Referring now to FIGS. 3 and 9, there is shown the construction of the side guards 26. The side guards consist of a plurality of parallel side rails 80 secured between vertical plates 81. The plates 81 are hingedly connected by levers 82 to a respective edge of the head support frame 23 or the foot support frame 22. The lower one of the transverse link arms 82 or 82' is formed with an engageable end 83. The engageable end has a notch 84 in a corner thereof which is engageable with a hook member 85 forming part of a hooking mechanism. The hooking mechanism simply comprises an elongated rod 86 extending longitudinally through the displaceable frame 16 and a lever arm 87 is connected thereto by a bushing 88 whereby the rod 86 may be rotated axially to disengage the hook member 85 from the notch 84. The engagement of the hook member in the notch 84 is achieved when the guide rails 80 are elevated to their position of use, as shown at 26' in FIG. 3. To disengage the side guards it is only necessary to lift them slightly and push the lever 87 upwardly to free the hook 85 from the notch 84. By maintaining the lever upwardly the engageable end 83 will clear the hook member 85 by pivoting on its pivot connection 89 and assume its non-use position as shown at 26 in FIG. 3.

It is within the ambit of the present invention to cover any obvious modifications of the example of the preferred embodiment described herein above, provided such modifications fall within the scope of the broad claims appended hereto.

We claim:

1. A hospital bed comprising a base frame, a displaceable frame supported above said base frame by adjustable leg supports, said leg supports being connected in pair and spaced apart adjacent a respective end of said frames, said leg supports of each pair operating in unison and each having an upper link arm and a lower link arm, said link arms being connected at a common end to a fixed pivot rod for displacement of their axes thereabout, said pivot rod being fixed relative to said displaceable frame, first drive means connected to said adjustable leg supports for causing said displaceable frame to be displaced above said base frame, and follower means connected to a lower end of said leg supports to maintain said displaceable frame in lateral relationship with said base frame when displaced relative thereof.

2. A hospital bed as claimed in claim 1 wherein said first drive means comprises a clutch mechanism for disengagement of a pair of said leg supports from said first drive means.

3. A hospital bed as claimed in claim 1 wherein said follower means comprises a link rod secured to said lower end of each one of said leg supports, said link rods of opposed ones of said leg supports of adjacent ends of said frames being interconnected by coupling means for axial displacement, said lower end of each one of said leg supports being slidingly retained in a respective base frame for longitudinal limited displacement therein.

4. A hospital bed as claimed in claim 3 wherein said coupling means is an idle gear in toothed engagement with a toothed section of each of said opposed ones of said link rods, said opposed link rods being engaged on opposed sides by said idle gear whereby said lower end of opposed leg supports will be slidingly displaced toward or away from each other in unison.

5. A hospital bed as claimed in claim 4 wherein said base frame has opposed parallel elongated channel members, said opposed link rods being located in said channel members, said lower end of each said leg supports having an idler wheel secured thereto and captive in an elongate slot for longitudinal displacement therein as said leg supports are displaced.

6. A hospital bed as claimed in claim 1 wherein said upper link arm of a pair of said leg supports has a top end secured to said first drive means for limited arcuate displacement thereof about said pivot rod to cause limited rotation of said pivot rod for displacement of said lower link arm for causing vertical displacement of its respective end of said frame.

7. A hospital bed as claimed in claim 6 wherein said first drive means is a threaded screw having an axial rotation drive connection at one end, said screw being threadedly engaged in a threaded housing, said top end of said upper link arm being pivotally secured to said threaded housing whereby longitudinal displacement of said housing is converted to arcuate displacement of said upper link arm.

8. A hospital bed as claimed in claim 7 wherein said axial rotation drive connection includes a universal joint coupling, a drive rod connected to said coupling, and a hand crank connected to said drive rod to impart axial rotation to said threaded screw.

9. A hospital bed as claimed in claim 8 wherein said first drive means comprises a clutch mechanism having a disengageable drive member connected to a further drive rod actuating said leg members at a single end of said frame, a resiliently biased displaceable plate secured to said disengageable drive member, a cam element abutting said displaceable plate, a clutch lever secured to said cam element to impart displacement thereof to shift said displaceable plate away from said drive member and disengage said drive member from said drive rod.

10. A hospital bed as claimed in claim 9 wherein said further drive rod is connected to a further threaded screw and housing mechanism as connected to said first pair of pivotal links.

11. A hospital bed as claimed in claim 9 wherein said clutch mechanism connects said drive rod and further drive rod through said drive member whereby said drive rods are rotated in unison to cause both ends of said displaceable frame to be displaced in unison.

12. A hospital bed as claimed in claim 7 wherein said threaded screw is supported through a bracket in an end portion adjacent said axial drive connection, said bracket being secured to said displaceable frame, aperture means in said bracket to permit limited vertical displacement of said screw as said upper link arm is arcuately displaced throughout its limited displacement arc.

13. A hospital bed as claimed in claim 12 wherein said pivot rod is axially supported between a pair of support plates depending from said displaceable frame, said threaded screw extending substantially transverse to said pivot rod.

14. A hospital bed as claimed in claim 1 wherein there is further provided an articulated panelized frame supported above said displaceable frame and having a plurality of panels hingedly interconnected, actuating means connected to selected ones of said panels, and second drive means connected to said actuating means for selectively displacing the angular position of some of said panels.

15. A hospital bed as claimed in claim 14 wherein said actuating means are displaceable levers, said second drive means having a pair of axially displaceable members supported under said displaceable frame and secured at one end to a respective one of said displaceable levers, a threaded bolt engaged with a respective one of said displaceable members and stationary relative to said displaceable frame, a crank secured to each threaded bolt to impart rotation thereto to cause axial displacement of said displaceable members thereby causing articulated displacement of panels associated with each said displaceable levers.

16. A hospital bed as claimed in claim 15 wherein said articulated support frame comprises a fixed middle section panel, an upper panel hingedly secured to an edge thereof and extending to one side thereof toward a headboard of said bed, a thigh panel hingedly secured to said middle section panel on an opposite edge to said edge having said upper panel secured thereto, and a foot panel hingedly connected to an opposed edge of said thigh panel, said displaceable members being connected respectively to said upper panel and said thigh panel.

17. A hospital bed as claimed in claim 14 wherein there is further provided a head support frame and a foot support frame secured at a respective end of said displaceable frame, side guards extending longitudinally on each side of said displaceable frame, a pair of transverse link arms hingedly secured at one end to a respective one of opposed ends of said side guards, said transverse link arms being hingedly secured at their other end to a respective side edge of a respective one of said head and foot support frames, one of said transverse link arms of each pair having an engageable end, a hooking mechanism for engaging said engageable end to retain said side guards in an elevated position above said articulated support frame.

18. A hospital bed as claimed in claim 17 wherein said hooking mechanism is an elongated rod extending longitudinally in said displaceable frame and having a lever secured thereto for limited axial rotation of said rod, a hook member secured adjacent each end of said rod in alignment with said engageable end of a respective one of said pairs of transverse link arms to retain said side guards elevated.

* * * * *